US005743649A

United States Patent [19]

Gonzalez

[11] Patent Number: 5,743,649

[45] Date of Patent: Apr. 28, 1998

[54] DIAPER BAG

[76] Inventor: Anita M. Gonzalez, 5934 Whispering Lake, San Antonio, Tex. 78222

[21] Appl. No.: 797,054

[22] Filed: Feb. 12, 1997

[51] Int. Cl.[6] ..... B65D 33/06; B65D 30/22

[52] U.S. Cl. ..... 383/6; 383/4; 383/39

[58] Field of Search ..... 383/4, 6, 38, 39

[56] References Cited

U.S. PATENT DOCUMENTS

| | | | |
|---|---|---|---|
| 2,674,288 | 4/1954 | Laidlaw | 383/39 X |
| 4,566,130 | 1/1986 | Coates . | |
| 4,685,570 | 8/1987 | Medow | 383/39 X |
| 4,886,150 | 12/1989 | Fitzsimmons | 383/4 X |
| 5,002,401 | 3/1991 | Blackman . | |
| 5,215,172 | 6/1993 | Stevenson . | |
| 5,439,154 | 8/1995 | Delligatti . | |

*Primary Examiner*—Jes F. Pascua

*Attorney, Agent, or Firm*—Patent & Trademark Services; Joseph H. McGlynn

[57] ABSTRACT

A diaper bag which contains a number of separate compartments for maximum organization and accessibility, yet is easy to carry. It is comprised of basically a flat rectangular piece of material, to which other materials, both opaque fabric and see through mesh fabric, are sewn as compartments in a configuration designed to arrange the infant care accessories in an orderly fashion. On the opposite side of the main piece of material is yet another compartment sewn on as a pocket. This pocket is lined with plastic, and has three elastic bottle holders within. At either end of the bag straps are sewn on for ease of portability. To carry this bag, one need only fold it in half with the several pockets on the inside of the fold, secure the two ends of the bag with fasteners and carry it by its straps.

2 Claims, 1 Drawing Sheet

DIAPER BAG

BACKGROUND OF THE INVENTION

This invention relates in general to tote bags designed for the purpose of carrying items necessary for the care of infants, and in particular to an improvement on the design, organization, ease of carrying, and usefulness of said type of tote bag.

DESCRIPTION OF THE PRIOR ART

In the prior art various types of tote bags have been available, for the care of infants as well as for other purposes. An example of prior art includes Blackman U.S. Pat. No. 5,002,401. This article holder and carrier was designed for school children, specifically for the purpose of organizing and carrying school supplies with ease and contains a number of separate pockets and compartments which are intended to aid the user in arranging his or her articles for maximum accessibility.

Stevenson U.S. Pat. No. 5,215,172, an "infant care platform", is a second example of prior art. It performs a double duty in that it is used for carrying infant supplies as well as enabling the parent to attend to changing the child's diaper on nearly any level spot.

A third example of prior art of this type is the Delligatti U.S. Pat. No. 5,439,154. This device, like the subject of this patent request, is also comprised of a number of separate compartments for the organization of the items within.

Coates U.S. Pat. No. 4,566,130 is the last example of prior art addressed. This item is similar in use to the Stevenson patent summarized above. The major difference between the two designs appears to be in the materials used. The Coates patent is fashioned from soft material, designed to cushion the support surface for the infant while the parent changes his or her diaper, while the Stevenson device intends to act directly as the support surface for the infant.

SUMMARY OF THE INVENTION

The present invention is directed to a simple yet effective diaper bag which contains a number of separate compartments for maximum organization and accessibility, yet is easy to carry. In a nutshell, it is comprised of basically a flat rectangular piece of material, to which other materials, both opaque fabric and see through mesh fabric, are sewn as compartments in a configuration designed to arrange the infant care accessories in an orderly fashion.

It is an object of the present invention to provide a light, simple, easy to carry diaper bag.

It is an object of the present invention to provide a diaper bag which has several compartments for maximum organization and maximum accessibility.

It is art object of the present invention to provide a diaper bag which is easy and inexpensive to assemble.

These and other objects and advantages of the present invention will be fully apparent from the following description, when taken in connection with the annexed drawings.

DESCRIPTION OF THE PREFERRED EMBODIMENT

Figure 1:
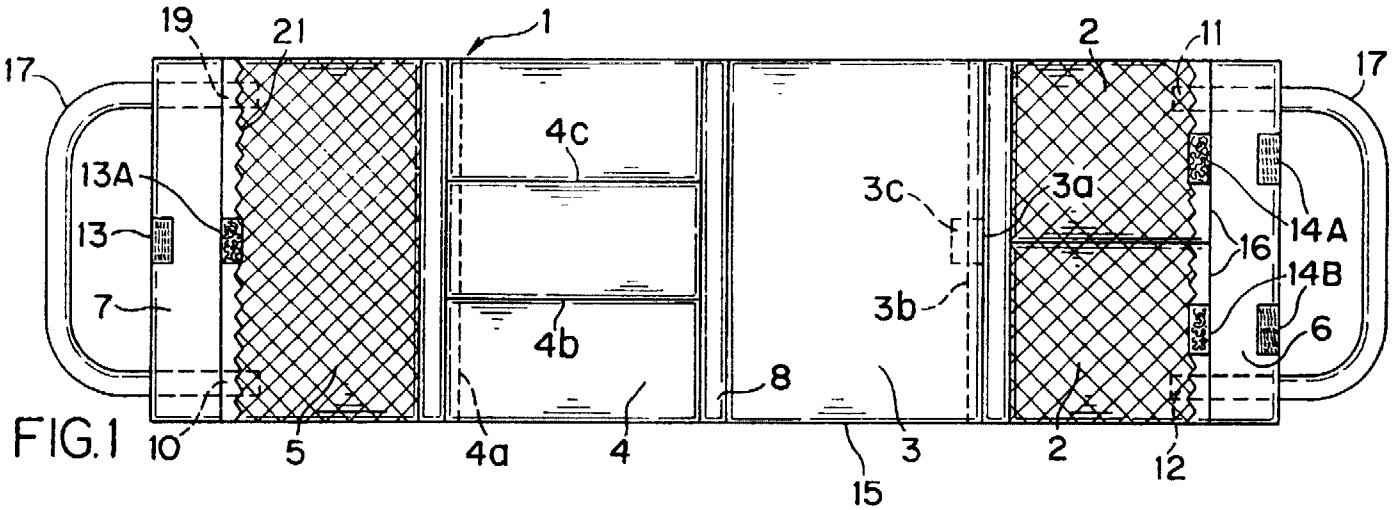
FIG. 1 is an interior view of the present invention.

Referring now to the drawings in greater detail, FIG. 1 shows the invention as it would appear when fully open. The invention, 1 consists of a flat, long piece of rectangular material 15 which is the foundation for this bag. This foundation may be made of any soft material such as flannel or corduroy. All other segments of the diaper bag are anchored to this piece of material.

As is apparent from FIG. 1, this bag is essentially divided into four equal sized portions when opened. Each interior portion is yet another rectangular piece of material sewn to the main foundation. Pockets 2, consisting of a mesh material, is sewn to the foundation piece to form a pair of pockets. Each of these pockets has a +e,fra 1+ee length opening 16, near the right edge (as seen in FIG. 1) of the foundation. This compartment is protected at the outer end, near the right edge of the foundation, by a flap 6, which runs the full length of the foundation. The flap 6 can be kept closed by two pair of VELCRO type hook and loop fasteners 14A, 14B. The open end of the pockets 2 has an elastic 21 runs from end to end to help keep articles in the pockets secure. The flap 6 can be made from the same material as the foundation 15.

A second piece of material 5, identical in function and description to material 2, is placed at the opposite end of the foundation (the left side as seen in FIG. 1). A flap 7 closes the pocket 5, similar to the flap 6, by means of VELCRO type hook and loop fasteners 13, 13A. In addition an elastic 21 runs from end to end to help keep articles in the pocket secure.

Going next to the middle segments of the interior of the diaper bag, as shown in FIG. 1, is yet another piece of rectangular material identical in size to all four interior pockets of this diaper bag. This material is composed of soft, opaque fabric such as, but not limited to, quilted flannel. Three ends of this piece of material are secured to the foundation, leaving the fourth end, 3*a*, fully open, as shown by the dotted line 3*b*, in a manner similar to element 2. Also, a VELCRO type hook and loop fastener 3C can be used to close the pocket 3.

Pocket 4 is virtually identical in function and design to pocket 3, with the exception of two seams sewn in, at 4*b* and 4*c*. The seams render this compartment into three small, equal sized pockets instead of one large pocket as in 3. In between pockets 3 and 4 is a gap 8, which fully separates the two pockets. This is the center point of the diaper bag which is evident when the bag is folded in half and ready to be carried. The gap 8 allows the bag to be folded for carrying even when the pockets 2–5 are filled with various articles. Note that the seams, 4*b* and 4*c*, are perpendicular to 8, and the pocket 4 opens to the left, as shown by the dotted line 4*a* in FIG. 1.

A piece of soft material similar to that used for the foundation of the bag may be used for the straps 17. The straps are attached at 9 and 10, and again at 11 and 12 on FIG. 1 by any conventional method such as, but not limited to, sewing. At 9 and 10, a scrap 17 made of a single piece of material, roughly 3 feet long and 1 inch wide, is attached, and an identical strap 17 is attached at 11 and 12. Note that the width and length of the strap material is not of vital importance as it would depend on the comfort requirements of the user.

With the arrangement of the pockets as shown in FIG. 1, there is no need to provide flaps on the interior pockets 3, 4, since the openings which allow items to be placed into these pockets will face up when the bag is folded. Therefore, in the folded position, the opening in pocket 3 will face the bottom of pocket 2, and the opening in pocket 4 will face the bottom of pocket 5. The bottoms of pockets 2,5 will help to prevent items from accidentally coming out of pockets 3,4.

Attached to the outside of flaps 6,7 are Velcro hook and loop fasteners 13 and 14. When this bag is being carried about, it is necessary that the two halves of the bag be secured together to make carrying the bag easier and to prevent the articles within from falling out. Thus, Velcro has been placed there for that purpose. To carry this bag, one folds it in half at 8 and secures the Velcro found at 13 and 14. The bag may then be carried conveniently by its straps. The fasteners are placed on the outside of the flaps because the flaps are normally closed when the bag is folded, and therefore, the fasteners will face each other when the flaps are closed. It should be noted that the Velcro hook and loop fasteners 13, 14 are merely for illustration purposes, and other fasteners such as, but not limited to, snaps, buttons, or ties could also be used.

Figure 2:
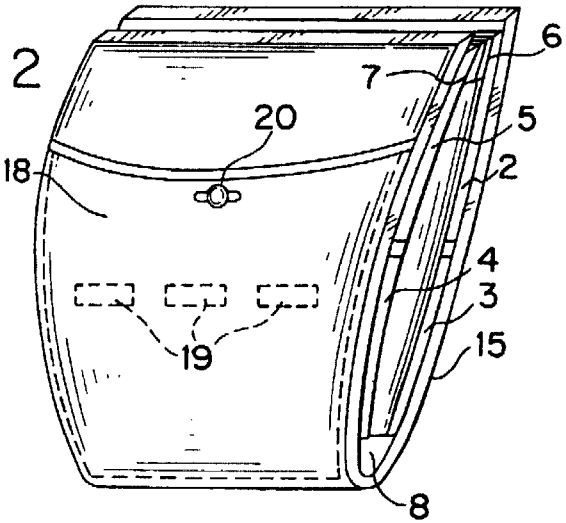
FIG. 2 is a perspective view of the present invention in the closed position.

FIG. 2 is a view of the bag when it is folded and ready for carrying. The straps have been removed in this figure for clarity. This figure displays the side pocket 18, which is an open pocket on the outside of the bag and which is designed for carrying larger articles. This pocket, 18, is made of a soft material similar to the rest of the diaper bag and the interior is lined with plastic. This pocket is secured to one half of the foundation piece of the diaper bag along three sides: the bottom of the folded bag, and also along both sides of the folded bag. The pocket stops about three inches short of the top of the bag. In addition, the interior of this pocket has three elastic holders 19 for the purpose of securing baby bottles. The large pocket, 18, is secured by a button arrangement 20, although other fasteners can also be used.

Although the diaper bag and the method Of using the same according to the present invention has been described in the foregoing specification with considerable detail, it is to be understood that modifications may be made to the invention which do not exceed the cope of the appended claims and modified forms of the present invention done by others skilled in the art to which the invention pertains will be considered infringements of this invention when those modified forms fall within the claimed scope of this invention.

What I claim as my invention is:

1. An article holder and carrier comprising:

fabric having top, bottom and side edges and an inside and outside surface, said inside surface having four compartments, a first two of said four compartments having openings which open toward a first side edge of said fabric, and a second two compartments having openings which open toward a side edge opposite from said first side edge, one of said first two compartments being made from a mesh material and having a flap means for closing said compartment, one of said second two compartments being made from a mesh material and having a flap means for closing said compartment, another of said first two compartments being made from a solid material and being divided into multiple pockets, fastener means attached adjacent said side edges for holding said fabric in a folded condition, and strap means attached adjacent said side edges for carrying said article holder.

2. The article holder and carrier as claimed in claim 1, wherein said outside surface has a pocket secured thereto, fastening means for closing said pocket, elastic means on an inside Surface of said pocket for securing articles within said pocket.

* * * * *